US009658581B2

(12) United States Patent
Mochizuki et al.

(10) Patent No.: US 9,658,581 B2
(45) Date of Patent: May 23, 2017

(54) HEATER AND IMAGE HEATING APPARATUS MOUNTED WITH THE SAME

(71) Applicant: CANON KABUSHIKI KAISHA, Tokyo (JP)

(72) Inventors: Keisuke Mochizuki, Suntou-gun (JP); Atsushi Iwasaki, Susono (JP); Masato Sako, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/258,844

(22) Filed: Sep. 7, 2016

(65) Prior Publication Data

US 2017/0075266 A1 Mar. 16, 2017

(30) Foreign Application Priority Data

Sep. 14, 2015 (JP) ..... 2015-181135

(51) Int. Cl.

*G03G 15/20* (2006.01)
*H05B 1/02* (2006.01)
*H05B 3/00* (2006.01)

(52) U.S. Cl.

CPC ..... *G03G 15/2039* (2013.01); *G03G 15/2042* (2013.01); *G03G 15/2053* (2013.01); *H05B 1/02* (2013.01); *H05B 1/0241* (2013.01); *H05B 3/0095* (2013.01)

(58) Field of Classification Search

CPC ..... G03G 15/2014; G03G 15/2042; G03G 15/2053; H05B 3/26; H05B 3/262

See application file for complete search history.

(56) References Cited

U.S. PATENT DOCUMENTS 8,471,178 B2 * 6/2013 Taniguchi ..... G03G 15/2042 219/216
8,552,342 B2 * 10/2013 Sakakibara ..... H05B 3/0095 219/216
8,592,726 B2 * 11/2013 Tsuruya ..... G03G 15/2042 219/216
9,095,003 B2 * 7/2015 Sakakibara ..... H05B 3/0095
9,098,035 B2 * 8/2015 Nakahara ..... G03G 15/2053

(Continued)

FOREIGN PATENT DOCUMENTS

JP 2001-43956 A 2/2001
JP 2010-54846 A 3/2010

(Continued)

*Primary Examiner* — Joseph M Pelham

(74) *Attorney, Agent, or Firm* — Canon U.S.A. Inc., IP Division

(57) ABSTRACT

A heater including a substrate, a first heat generating line provided on the substrate and in a longitudinal direction of the substrate, the first heat generating line being divided into a plurality of heat generating blocks in the longitudinal direction, the plurality of heat generating blocks being controllable independently, and a second heat generating line provided on the substrate and in the longitudinal direction of the substrate, the second heat generating line being divided into a plurality of heat generating blocks in the longitudinal direction, the plurality of heat generating blocks being controllable independently. In the heater, divided positions of the first heat generating line and divided positions of the second heat generating line are different.

7 Claims, 12 Drawing Sheets

(56) References Cited

U.S. PATENT DOCUMENTS 9,445,457 B2 * 9/2016 Sakakibara ..... H05B 3/0095
9,494,899 B2 * 11/2016 Nakahara ..... G03G 15/2053
2011/0062140 A1 * 3/2011 Sakakibara ..... H05B 3/0095 219/216
2012/0121306 A1 * 5/2012 Shimura ..... H05B 3/0095 399/329
2012/0201581 A1 * 8/2012 Shimura ..... G03G 15/2082 399/329
2012/0201582 A1 * 8/2012 Shimura ..... H05B 3/0095 399/329
2012/0308280 A1 * 12/2012 Tsuruya ..... G03G 15/2042 399/329
2013/0251428 A1 * 9/2013 Ueno ..... H05B 3/12 399/333
2013/0299480 A1 * 11/2013 Kakubari ..... G03G 15/2053 219/216
2013/0343790 A1 * 12/2013 Shimura ..... G03G 15/2053 399/329
2013/0343791 A1 * 12/2013 Shimura ..... G03G 15/2053 399/329
2014/0003848 A1 * 1/2014 Sakakibara ..... H05B 3/0095 399/335
2014/0076878 A1 * 3/2014 Shimura ..... G03G 15/2042 219/216
2014/0169845 A1 * 6/2014 Nakahara ..... G03G 15/2053 399/328
2015/0289317 A1 * 10/2015 Sakakibara ..... H05B 3/0095 399/329
2015/0293483 A1 * 10/2015 Nakahara ..... G03G 15/2053 399/333

FOREIGN PATENT DOCUMENTS

JP 2014-59508 A 4/2014
JP 2014-153480 A 8/2014

* cited by examiner

300

HEATER AND IMAGE HEATING APPARATUS MOUNTED WITH THE SAME

BACKGROUND

Field

The present disclosure relates to an image heating apparatus, such as a fixing device mounted in an image forming apparatus including a copier and a printer employing an electrophotographic method or an electrostatic recording method, or a glossing device that improves a gloss of a toner image by reheating a fixed toner image on a recording material. Furthermore, the present disclosure relates to a heater used in the image heating apparatus.

Description of the Related Art

There is a device, serving as an image heating apparatus, including a cylindrical film, a heater that is in contact with an inner surface of the heater, and a roller that forms a nip portion together with the heater with the film in between. When small-sized sheets are continuously printed in the image forming apparatus in which the image heating apparatus is mounted, a phenomenon (a sheet non-passing portion temperature rise) in which temperature in the areas of the nip portion in a longitudinal direction where the sheets do not pass rises occurs. When the temperature of the sheet non-passing portion becomes excessively high, the parts inside the device may be damaged, and there may be cases in which, when a large-sized sheet is printed while the sheet non-passing portion temperature rise is occurring, the toner causes a high temperature offset to occur on the area of the film corresponding to the small-sized sheet non-passing portion.

As a technique of suppressing the sheet non-passing portion temperature rise from occurring, a device in which a heat generation resistor on a heater is divided into a plurality of groups (heat generating blocks) in the longitudinal direction of the heater so as to switch the heat distribution of the heater according to the size of the recording material has been proposed (Japanese Patent Laid-Open No. 2014-59508).

The sizes of the recording material used in the device are diverse and a heater that is capable of forming heat distributions that are suitable for various sheet size is in need.

SUMMARY

The present disclosure provides a heater and an image heating apparatus that are capable of forming heat distributions suitable for a variety of sheet sizes.

The present disclosure provides a heater including a substrate, a first heat generating line provided on the substrate and in a longitudinal direction of the substrate, the first heat generating line being divided into a plurality of heat generating blocks in the longitudinal direction, the plurality of heat generating blocks being controllable independently, and a second heat generating line provided on the substrate and in the longitudinal direction of the substrate, the second heat generating line being divided into a plurality of heat generating blocks in the longitudinal direction, the plurality of heat generating blocks being controllable independently. In the heater, divided positions of the first heat generating line and divided positions of the second heat generating line are different in the longitudinal direction, and the first heat generating line and the second heat generating line are each configured such that an electric current flows in a heating element of the heat generating blocks of the first heat generating line and a heating element of the heat generating blocks in the second heat generating line in a direction that intersects the longitudinal direction.

Further features of aspects of the present invention will become apparent from the following description of exemplary embodiments with reference to the attached drawings.

DESCRIPTION OF THE EMBODIMENTS

Figure 1:
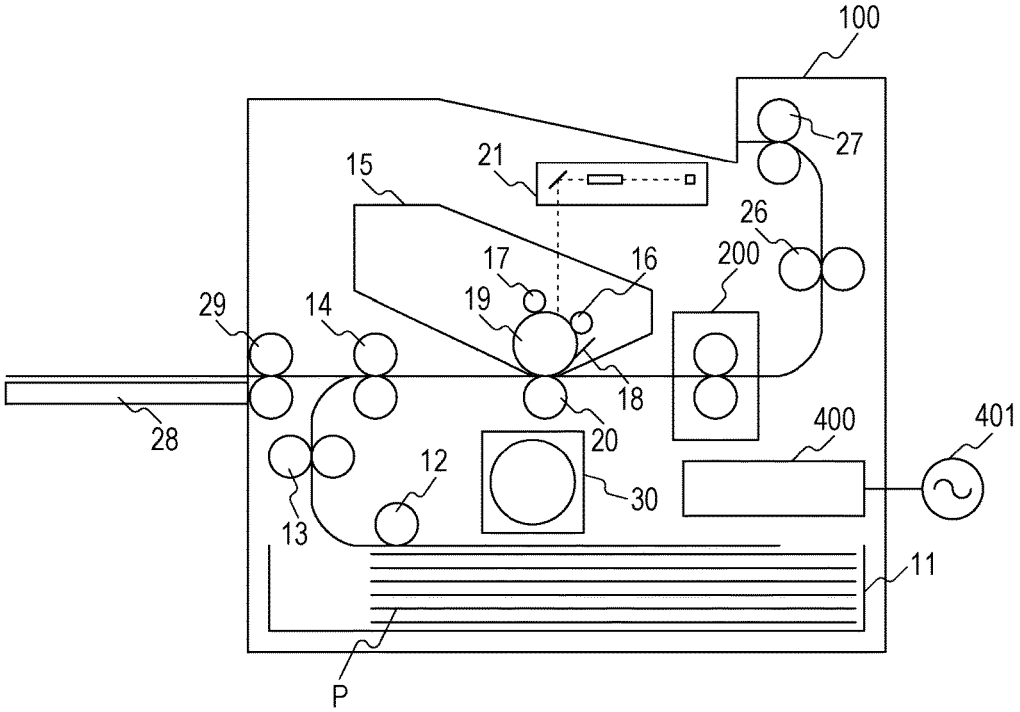
FIG. 1 is a cross-sectional view of an image forming apparatus.

Hereinafter, referring to the drawings, modes to implement the present discloser will be exemplified in detail with the exemplary embodiments. Note that the dimensions, the materials, and the shapes of the components, the relative configuration of the components, and the like that are described in the following exemplary embodiments are to be appropriately altered based on the device to which the present disclosure is applied and on various conditions. In other words, the scope of the disclosure is not intended to be limited by the exemplary embodiments below.

First Exemplary Embodiment

1. Configuration of Image Forming Apparatus

FIG. 1 is a schematic cross-sectional view of an image forming apparatus 100 according to an exemplary embodiment of the present disclosure. The image forming apparatus 100 of the present exemplary embodiment is a laser printer that forms an image on a recording material using an electrophotographic method. When a print signal is generated, a scanner unit 21 emits a laser beam that has been modulated according to a piece of image information and scans a surface of a photosensitive drum 19 charged with a predetermined polarity with a charge roller 16. With the above, an electrostatic latent image is formed on the photosensitive drum 19. By supplying toner to the electrostatic latent image from a developing roller 17, the electrostatic latent image on the photosensitive drum 19 is developed into a toner image. Meanwhile, recording materials (sheets of recording paper) P stacked in a sheet supplying cassette 11 is fed sheet by sheet with a pickup roller 12 and is conveyed towards a pair of registration rollers 14 with a pair of conveyance rollers 13. Furthermore, the recording material P is conveyed to a transfer position, which is between the photosensitive drum 19 and a transfer roller 20, from the pair of registration rollers 14 so as to match the timing at which the toner image on the photosensitive drum 19 reaches the transfer position. While the recording material P passes through the transfer position, the toner image on the photosensitive drum 19 is transferred onto the recording material P. Subsequently, the recording material P is heated in a fixing apparatus (an image heating apparatus) 200 such that the toner image is heated and fixed to the recording material P. The recording material P bearing the fixed toner image is discharged on a tray at an upper portion of the image forming apparatus 100 with pairs of conveyance rollers 26 and 27.

Note that reference numeral 18 is a drum cleaner that cleans the photosensitive drum 19, and reference numeral 28 is a feed tray (a manual feed tray) including a pair of recording material restricting plate that are capable of width adjusting according to the size of the recording material P. The feed tray 28 is provided for coping with recording materials P with sizes other than the standard size. Reference numeral 29 is a pickup roller that feeds the recording material P from the feed tray 28, and reference numeral 30 is a motor that drives a roller 208 and the like in the fixing apparatus. Electric power is supplied to a heater 300 in the fixing apparatus 200 from a control circuit 400 serving as a heater driving unit. The photosensitive drum 19, the charge roller 16, the scanner unit 21, the developing roller 17, and the transfer roller 20 described above constitute an image forming unit that forms an unfixed image on the recording material P. Furthermore, in the present exemplary embodiment, the developing unit including the photosensitive drum 19, the charge roller 16, and the developing roller 17, and the cleaning unit including a drum cleaner 18 are configured as a process cartridge 15 that is detachable with respect to the main body of the image forming apparatus 100.

The image forming apparatus 100 of the present exemplary embodiment corresponds to a plurality of recording material sizes. Letter paper (215.9 mm×279.4 mm), legal paper (215.9 mm×355.6 mm), A4 paper (210 mm×297 mm), and executive paper (184.2 mm×266.7 mm) can be set in the sheet supplying cassette 11. Furthermore, JIS B5 paper (182 mm×257 mm), A5 paper (148 mm×210 mm), and the like can be set. Non-standard-sized sheets including a DL envelope (110 mm×220 mm) and a COM 10 envelope (about 105 mm×241 mm) can be fed from the feed tray 28 and can be printed.

The image forming apparatus 100 of the present exemplary embodiment basically performs a short edge feed of the sheets of paper (conveys the sheets of paper such that the long side thereof is parallel to the conveyance direction). In the command 100, the maximum sheet-passing width of the recording material P is 215.9 mm and the minimum sheet-passing width is 76.2 mm. Note that the printer of the present exemplary embodiment is a center-referring image forming apparatus that conveys the recording material while matching the center of the recording material in the width direction with a conveyance reference X set at the center of the heater in the longitudinal direction.

2. Configuration of Fixing Apparatus

Figure 2:
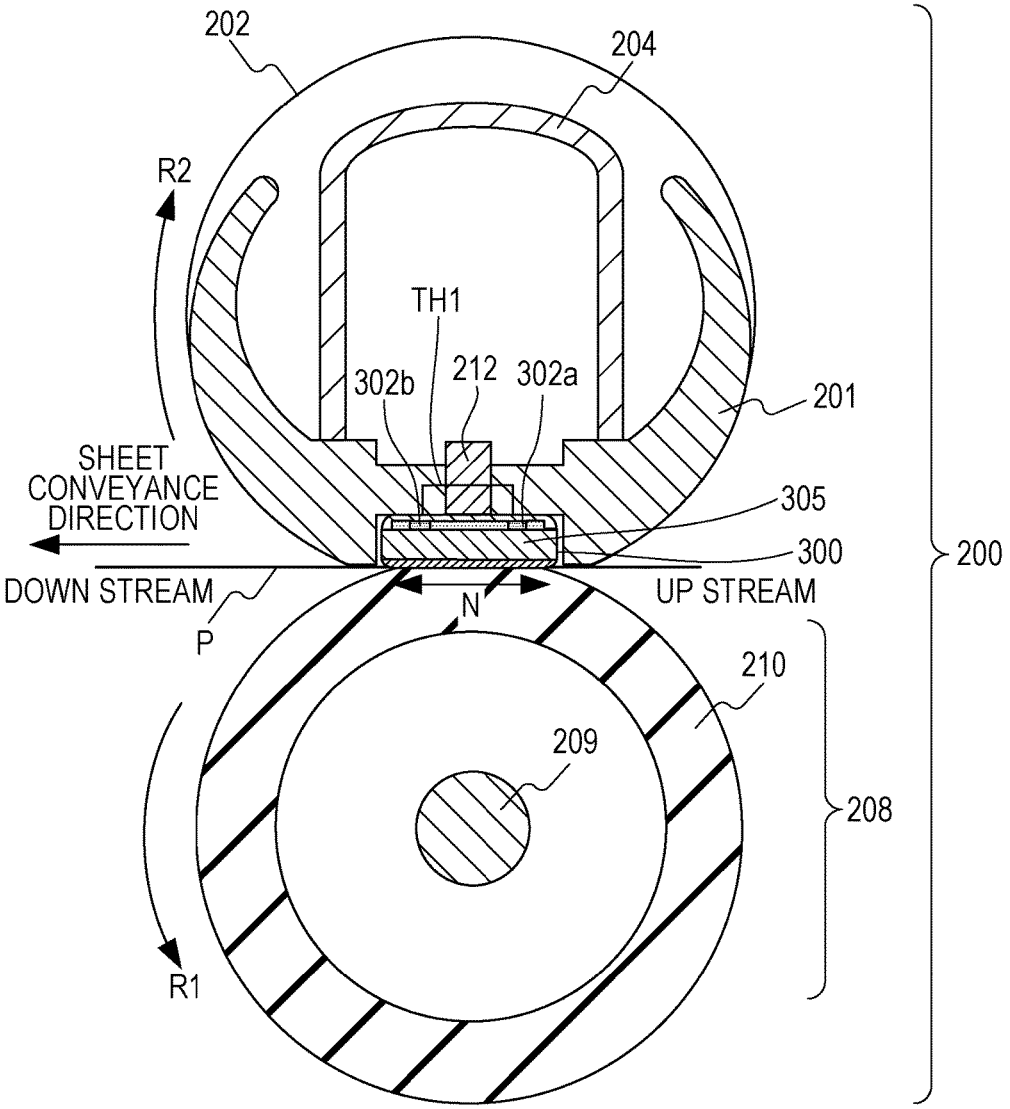
FIG. 2 is a cross-sectional view of an image forming apparatus of a first exemplary embodiment.

FIG. 2 is a cross-sectional view of the fixing apparatus 200 of the present exemplary embodiment. The fixing apparatus 200 includes a cylindrical fixing film 202, the heater 300 that is in contact with an inner surface of the fixing film 202, the pressure roller 208 that forms a fixing nip portion N together with the heater 300 with the fixing film 202 in between, and a metal stay 204. The fixing film 202 is a multi-layered heat resisting film having a heat resistant resin, such as polyimide, or a metal, such as stainless steel, as the base layer. Furthermore, a release layer is formed on the surface of the fixing film 202 by coating a heat resistant resin having excellent releasability, such as tetrafluoroethylene-perfluoro alkyl vinyl ether copolymer (PFA), so as to prevent adhesion of the toner and to obtain separativeness when the recording material P. The pressure roller 208 includes a metal core 209 formed of a material such as iron or aluminum, and an elastic layer 210 formed of a material such as silicone rubber. The heater 300 is held by a heater holding member 201 made of heat resistant resin and heats the fixing film 202. The heater holding member 201 also has a guiding function that guides the rotation of the fixing film 202. The metal stay 204 receives a pressure (not shown) and biases the heater holding member 201 towards the pressure roller 208.

By receiving motive power from a motor 30, the pressure roller 208 rotates in an arrow R1 direction. By following the rotation of the rotating pressure roller 208, the fixing film 202 rotates in an arrow R2 direction. A fixing process is performed on the unfixed toner image on the recording material P by applying heat to the fixing film 202 while the recording material P is pinched and conveyed at the fixing nip portion N. A thermistor TH1, which is an example of a temperature detection member, abuts against the heater 300. Control of electric power to the heater 300 is performed on the basis of an output of the thermistor TH1 provided at about the middle of the heater 300 in the longitudinal direction. Furthermore, a safety element 212, such as a thermal switch or a thermal fuse, that is actuated by abnormal heat generation of the heater 300 and that cuts off the electric power supplied to the heater 300 also abuts against the heater 300.

3. Configuration of Heater

Figure 3A:
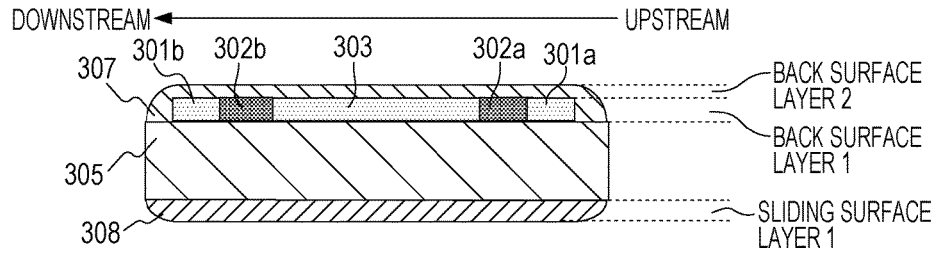
FIGS. 3A to 3C are block diagrams of a heater of the first exemplary embodiment.
Figure 3B:
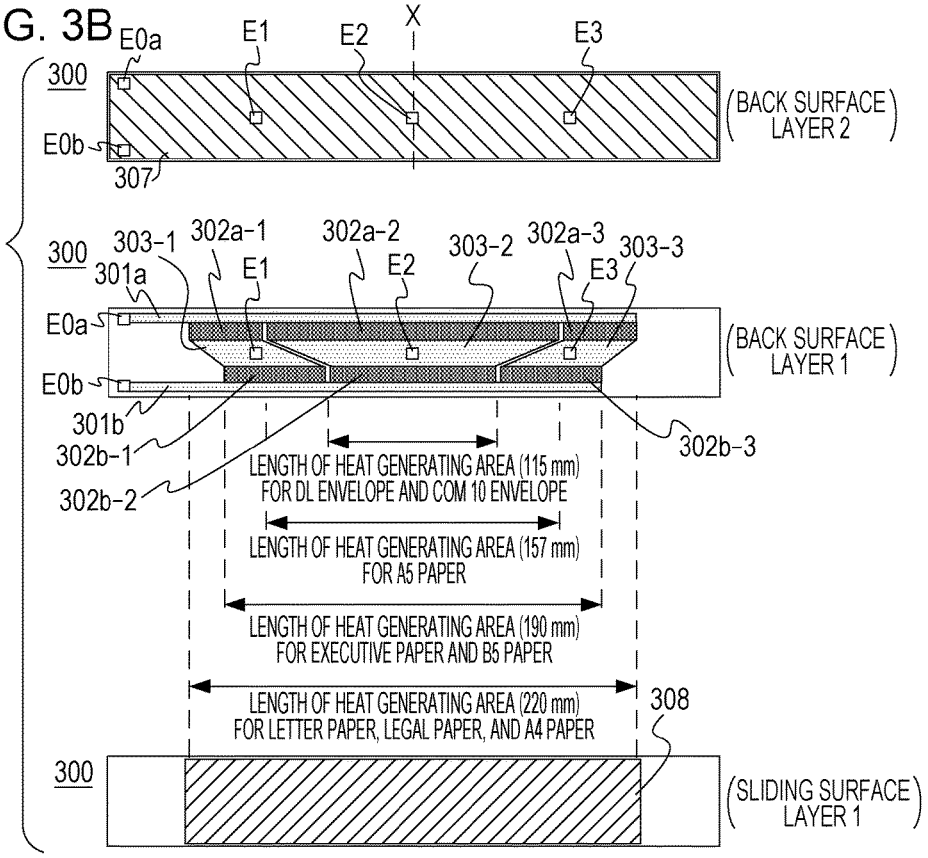
Figure 3C:
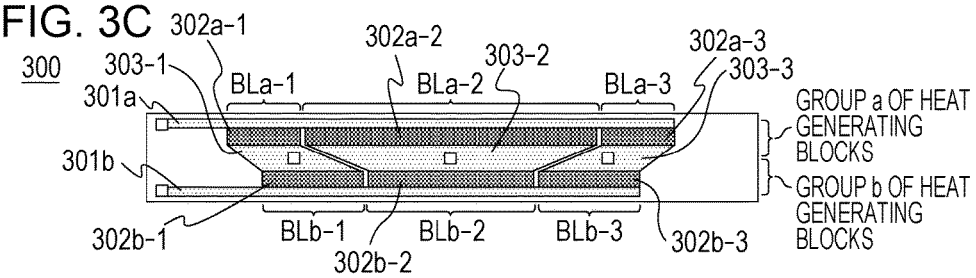

FIGS. 3A to 3C are diagrams illustrating a configuration of the heater 300. FIG. 3A is a cross-sectional view of the heater 300. FIG. 3B illustrates plan views of layers of the heater 300. FIG. 3C is a diagram illustrating a positional relationship of the heat generating areas.

The heater 300 includes a ceramic substrate 305, and heating elements 302*a* and 302*b* provided on the substrate 305. The heating element 302*a* and the heating element 302*b* are each configured such that application of power can be controlled independently. As described later, the heating element 302*a* is divided into three heat generating blocks in a longitudinal direction (a direction that is orthogonal to the conveyance direction of the recording material) of the heater 300, and is configured so that the heat generating area in the longitudinal direction can be switched in two stages. In a similar manner and as described later, the heating element 302*b* is divided into three heat generating blocks in the longitudinal direction of the heater 300, and is configured so that the heat generating area in the longitudinal direction can be switched in two stages. Since the divided positions of the heat generating blocks of the heating element 302*a* and the divided positions of the heat element 302*b* are different in the longitudinal direction of the heater 300, the heater 300 is configured so as to be capable of switching the heat generating area in the longitudinal direction in four stages.

The heater 300 includes the ceramic substrate 305, a sliding surface layer 1 that is a surface that comes into contact with the film 202, a back surface layer 1 that is provided on the substrate 305, and a back surface layer 2 that covers the back surface layer 1. The sliding surface layer 1 includes a surface protecting layer 308 formed by coating glass or polyimide. The back surface layer 1 includes conductors and heating elements. The back surface layer 2 includes an insulating (glass in the present exemplary embodiment) surface protecting layer 307.

The back surface layer 1 includes a conductor 301*a* and a conductor 301*b* serving as a conductor A provided in the longitudinal direction of the heater 300. The conductor 301*b* is disposed downstream in the conveyance direction of the recording material P with respect to the conductor 301*a*. Furthermore, the back surface layer 1 includes a conductor 303 (303-1, 301-2, and 303-3) serving as a conductor B provided parallel to the conductors 301*a* and 301*b*. The conductor B is provided between the conductor 301*a* and the conductor 301*b* and in the longitudinal direction of the heater 300.

Furthermore, the back surface layer 1 includes the heating element 302*a* (302*a*-1, 302*a*-2, and 302*a*-3) and the heating element 302*b* (302*b*-1, 302*b*-2, and 302*b*-3). The heating elements 302*a* and 302*b* are formed of a substance that has a positive resistance temperature characteristic. A positive resistance temperature characteristic is a characteristic in which the resistance value increases when the temperature increases. The heating element 302*a* is provided between the conductor 301*a* and the conductor 303, and generates heat by having power applied thereto through the conductor 301*a* and the conductor 303. The heating element 302*b* is provided between the conductor 301*b* and the conductor 303, and generates heat by having power applied thereto through the conductor 301*b* and the conductor 303.

A heating member constituted by the conductor 301*a*, the conductor 303, and the heating element 302*a* is divided into three heat generating blocks (BLa-1, BLa-2, and BLa-3) in the longitudinal direction of the heater 300. In other words, the heating element 302*a* is divided into three areas, namely, the heating elements 302*a*-1, 302*a*-2, and 302*a*-3 in the longitudinal direction of the heater 300. Furthermore, the conductor 303 connected to the heating element 302*a* is divided into three areas, namely, the conductor 303-1, 303-2, and 303-3, so as to correspond to the divided areas of the heating element 302*a*. A group constituted by the heating element 302*a*-1, the conductor 303-1, and the conductor 301*a* is referred to as a heat generating block BLa-1. Similarly, a group constituted by the heating element 302*a*-2, the conductor 303-2, and the conductor 301*a* is referred to as a heat generating block BLa-2. Furthermore, a group constituted by the heating element 302*a*-3, the conductor 303-3, and the conductor 301*a* is referred to as a heat generating block BLa-3. The three heat generating blocks BLa-1, BLa-2, and BLa-3 constitute a group a of heat generating blocks serving as a first heat generating line. As illustrated in FIG. 3B, electrodes E0*a* and E0*b* are provided in the heater 300. The electrode E0*a* is an electrode for supplying electric power to the group a of heat generating blocks through the conductor 301*a*. Similarly, the electrode E0*b* is an electrode for supplying electric power to a group b of heat generating blocks through the conductor 301*b*. Furthermore, electrodes E1, E2, and E3 are provided in the areas of the conductors 303-1, 303-2, and 303-3, respectively. The electrode E1 is an electrode for supplying electric power to the heat generating block BLa-1 and the heat generating block BLb-1 through the conductor 303-1. The electrode E2 is an electrode for supplying electric power to the heat generating block BLa-2 and the heat generating block BLb-2 through the conductor 303-2. The electrode E3 is an electrode for supplying electric power to the heat generating block BLa-3 and the heat generating block BLb-3 through the conductor 303-3. The surface protecting layer 307 constituting the back surface layer 2 is formed at a portion other than the portions of the electrodes E0*a*, E0*b*, E1, E2, and E3. Accordingly, electric contacts C (C0*a*, C0*b*, C1, C2, and C3) for supplying electric power can be connected to each electrode from the back surface side of the heater.

By connecting the electric contacts described later to the electrodes, each of the heat generating blocks in the group a of heat generating blocks can be controlled independently.

Similar to the group a of heat generating blocks, a heating member constituted by the conductor 301*b*, the conductor 303, and the heating element 302*b* is divided into three heat generating blocks (BLb-1, BLb-2, and BLb-3) in the longitudinal direction of the heater 300. In other words, the heating element 302*b* is divided into three areas, namely, the heating elements 302*b*-1, 302*b*-2, and 302*b*-3 in the longitudinal direction of the heater 300. Furthermore, the conductor 303 connected to the heating element 302*b* is divided into three areas, namely, the conductor 303-1, 303-2, and 303-3, so as to correspond to the divided areas of the heating element 302*b*. A group constituted by the heating element 302*b*-1, the conductor 303-1, and the conductor 301*b* is referred to as a heat generating block BLb-1. Similarly, a group constituted by the heating element 302*b*-2, the conductor 303-2, and the conductor 301*b* is referred to as a heat generating block BLb-2. Furthermore, a group constituted by the heating element 302*b*-3, the conductor 303-3, and the conductor 301*b* is referred to as a heat generating block BLb-3. The three heat generating blocks BLb-1, BLb-2, and BLb-3 constitute the group b of heat generating blocks serving as a second heat generating line. Each of the heat generating blocks in the group b of heat generating blocks can be controlled independently.

As described above, the first heat generating line that is divided into a plurality of heat generating blocks that are capable of being independently controlled with respect to each other in the longitudinal direction of the heater 300 is provided on the substrate 305 in the longitudinal direction of the heater 300 (in the longitudinal direction of the substrate 305). Furthermore, the second heat generating line that is divided into a plurality of heat generating blocks that are capable of being independently controlled with respect to each other in the longitudinal direction of the heater 300 is provided on the substrate 305 in the longitudinal direction of the heater 300.

Furthermore, the first heat generating line and the second heat generating line are configured such that in the plurality of heat generating blocks, heating elements are connected between the pair of conductors (the conductors A and B) provided in the longitudinal direction of the heater 300 so that an electric current flows in the heating elements in a direction that is orthogonal to the longitudinal direction of the heater 300.

Boundary positions between the heat generating blocks that constitute the group a of heat generating blocks and the heat generating blocks that constitute the group b of heat generating blocks are set in a bilaterally symmetrical manner with the conveyance reference X of the recording material P as the central axis. The boundary between the heat generating block BLa-1 and the heat generating block BLa-2, and the boundary between the heat generating block BLa-2 and the heat generating block BLa-3 are set at positions that are 78.5 mm in the left and right from the conveyance reference X. Accordingly, the heat generating area of the heat generating block BLa-2 is 157 mm in width extending 78.5 mm in the left and right from the conveyance reference X. Similarly, the boundary between the heat generating block BLb-1 and the heat generating block BLb-2, and the boundary between the heat generating block BLb-2 and the heat generating block BLb-3 are set at positions that are 57.5 mm in the left and right from the conveyance reference X. Accordingly, the heat generating area of the heat generating block BLb-2 is 115 mm in width extending 57.5 mm in the left and right from the conveyance reference X. Furthermore, the entire length of the group a of heat generating blocks is 220 mm. The entire length of the group b of heat generating blocks is 190 mm. As described above, the heat generating area of the entire first heat generating line in the longitudinal direction of the heater 300 is different from the heat generating area of the entire second heat generating line in the longitudinal direction of the heater 300.

As described above, the heat generating area of the entire first heat generating line in the longitudinal direction of the heater 300 is different from the heat generating area of the entire second heat generating line in the longitudinal direction of the heater 300. Furthermore, the divided positions of the first heat generating line and the divided positions of the second heat generating line are different. Accordingly, the heat distribution in the longitudinal direction of the heater 300 formed in one of the heat generating blocks in the first heat generating line is a heat distribution that cannot be formed by combining one, or two or more heat generating blocks in the second heat generating line. Furthermore, each of the heat generating blocks of the first heat generating line and each of the heat generating blocks of the second heat generating line are controlled according to information on the size and the like of the recording material. Control of the heater control circuit and that of each heat generating block will be described later.

As illustrated in FIG. 3B, the conductor 303 common between the first heat generating line and the second heat generating line is divided by oblique lines that connect the divided positions on the heating element 302*a* side and the divided positions on the heating element 302*b* side. Other than dividing with oblique lines, modes illustrated in FIGS. 4A and 4B may be adopted.

Figure 4A:
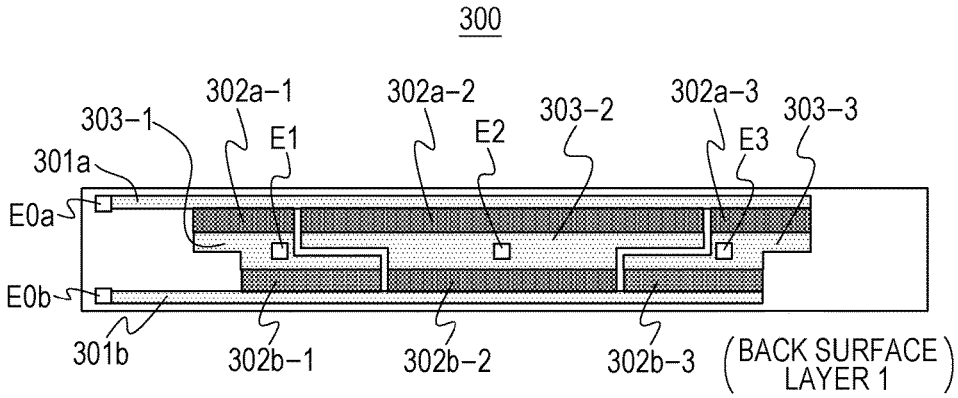
FIGS. 4A and 4B are diagrams illustrating modifications of the heater of the first exemplary embodiment.

FIG. 4A is an example of a mode in which the conductor 303 is divided in a step-like manner.

Figure 4B:
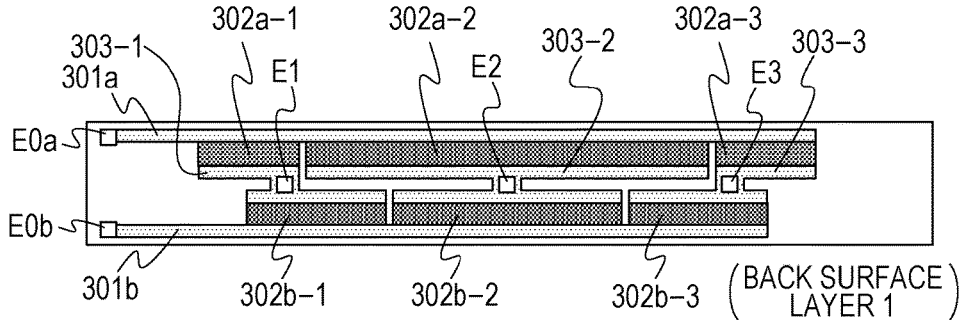

FIG. 4B is an example of a configuration in which the conductor 303 is divided into two, that is, on the upstream side and on the downstream side, in the conveyance direction of the recording material P, and in which the conductor 303 on the upstream side and the conductor 303 on the downstream side are connected with conductors in which electrodes E1 to E3 are disposed. Other than the above, a mode in which the conductor 303 is divided by a bent line or a mode in which the modes described above are combined may be adopted.

Figure 5A:
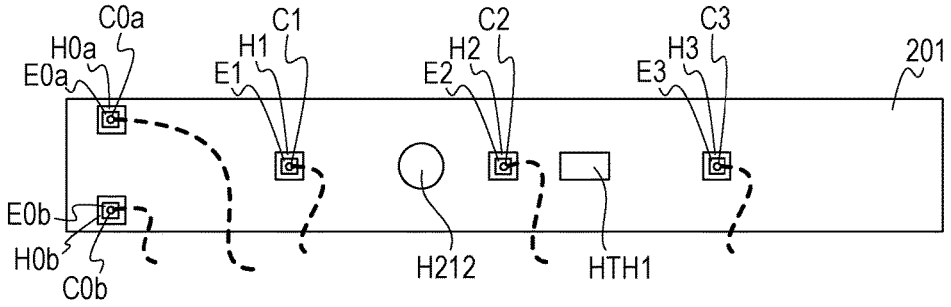
FIGS. 5A to 5C are schematic diagrams illustrating a method of connecting feeding cables of the first exemplary embodiment.
Figure 5B:
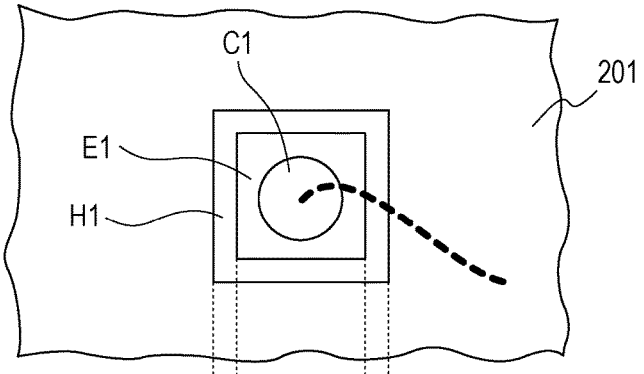
Figure 5C:
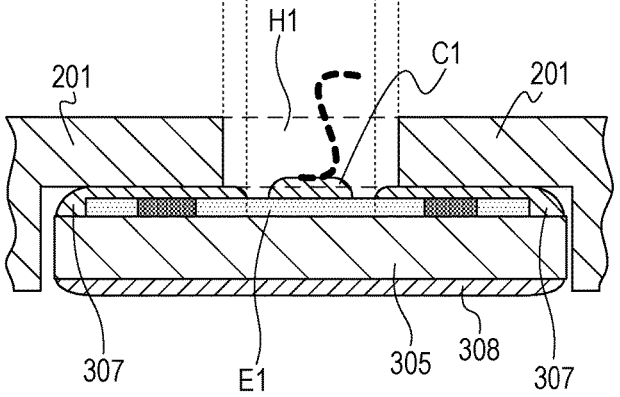

A method of connecting the electrodes to electric contacts C is illustrated in FIGS. 5A to 5C. FIG. 5A is a plan view illustrating a state viewed from the heater holding member 201 side in which the electric contacts C are connected to the electrodes, FIG. 5B is an enlarged plan view of a vicinity of the electric contact C1, and FIG. 5C is an enlarged cross-sectional view of the vicinity of the electric contact C1. As illustrated in FIG. 5A, electric contacts C0*a*, C0*b*, C1, C2, and C3 are connected to the electrodes E0*a*, E0*b*, E1, E2, and E3, respectively. In FIGS. 5A to 5C, broken lines connected to the electric contacts are feeding cables and are connected to the electric contacts C to supply electric power from the control circuit 400 of the heater 300 described later. The feeding cables pass through holes H (H0*a*, H0*b*, H1, H2, and H3) provided in the heater holding member 201, and are drawn into the space surrounded by the heater holding member 201 and the metal stay 204. Then, the feeding cables are drawn out from an end portion of the film 202 in the longitudinal direction and are connected to the control circuit 400. Note that in FIG. 5A, HTH1 is a hole provided in the heater holding member 201 for disposing the thermistor TH1. H212 is a hole provided in the heater holding member 201 for disposing the safety element 212, such as a thermal switch or a thermal fuse.

4. Configuration of Heater Control Circuit

Figure 6:
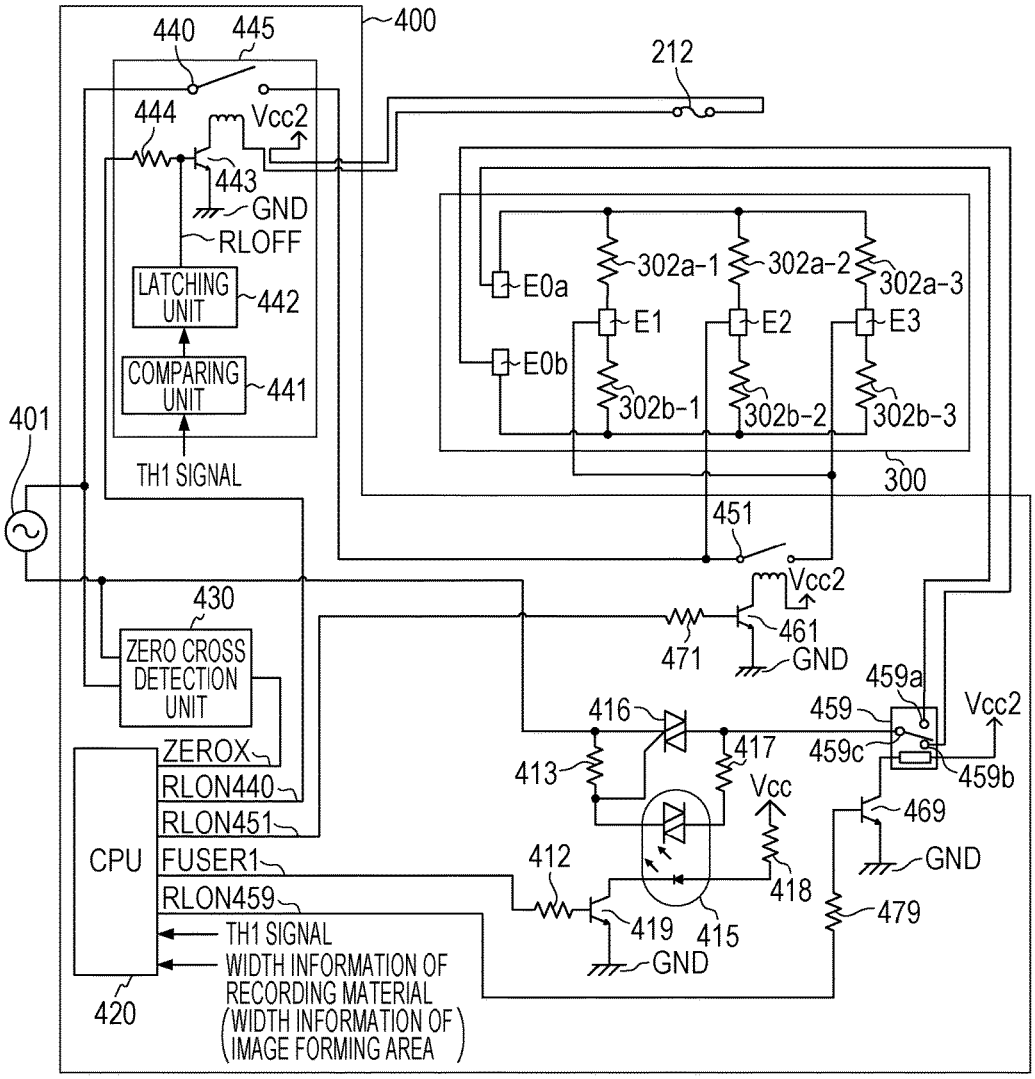
FIG. 6 is a control circuit diagram of the heater of the first exemplary embodiment.

FIG. 6 is a circuit diagram of the control circuit 400 serving as the heater driving unit of the first exemplary embodiment. The control circuit 400 is capable of switching the heat generating area in the longitudinal direction of the heater 300 by using a relay 451 and a double pole switching relay 459. Reference numeral 401 is a commercial AC power source. A zero cross detection unit 430 is a circuit that detects zero crossing of the AC power source 401 and outputs a ZEROX signal to a CPU 420. The ZEROX signal is used to control the heater 300.

A relay 440 is used as an electric power cut-off unit that cuts off supply of electric power to the heater when the temperature of the heater rises excessively due to malfunction or the like. The relay 440 is activated by an output from the thermistor TH1. When an RLON 440 signal turns high, a transistor 443 is turned on, power from a power source Vcc2 is applied to a coil on the secondary side of the relay 440, and a contact on a primary side of the relay 440 is turned on. When an RLON 440 signal turns low, the transistor 443 is turned off, current from the power source Vcc2 flowing to the coil on the secondary side of the relay 440 is cut off, and the contact on the primary side of the relay 440 is turned off. Note that a resistor 444 is a current limit resistor.

An operation of a safety circuit 445 using the relay 440 will be described. When a detection temperature (TH1 signal) of the thermistor TH1 exceeds a predetermined value, a comparing unit 441 operates a latching unit 442, and the latching unit 442 latches the RLOFF signal at a low state. Even if the CPU 420 turns the RLON 440 signal high when the RLOFF signal turns low, since the transistor 443 is kept off, the relay 440 is kept off (is kept in a safe state). Furthermore, electric power to the coil on the secondary side of the relay 440 is suppled through the safety element 212. Accordingly, when the temperature of the heater rises excessively due to malfunction or the like, the safety element 212 is actuated and the supply of electric power to the coil on the secondary side of the relay 440 is cut off, such that the contact on the primary side of the relay 440 is turned off. When the detection temperature of the thermistor TH1 does not exceed the predetermined value that has been set, the RLOFF signal of the latching unit 442 turns into an open state. Accordingly, when the CPU 420 turns the RLON 440 signal high, the relay 440 can be turned on and electric power can be supplied to the heater 300.

An operation of the switching relay 459 will be described. The switching relay 459 is disposed between the groups of heat generating blocks of the heater 300 and a triac 416 described later, and is capable of selecting to which of the group a of heat generating blocks and the group b of heat generating blocks power is to be applied. A contact 459*a* of the switching relay 459 is connected to the group a of heat generating blocks through the electrode E0*a*. A contact 459*b* of the switching relay 459 is connected to the group b of heat generating blocks through the electrode E0*b*. A contact 459*c* of the switching relay 459 is connected to the triac 416. The switching relay 459 operates according to an RLON 459 signal from the CPU 420 sent through a current limit resistor 479. When the RLON 459 signal turns high, a transistor 469 is turned on and the switching relay 459 connects the contacts 459*a* and 459*c* to each other. With the above, power can be applied to the group a of heat generating blocks from the triac 416. On the other hand, when the RLON 459 signal turns low, the transistor 469 is turned off and the switching relay 459 connects the contacts 459*b* and 459*c* to each other. With the above, power can be applied to the group b of heat generating blocks from the triac 416.

An operation of the relay 451 will be described. The relay 451 operates according to an RLON 451 signal from the CPU 420. When the RLON 451 signal turns high, a transistor 461 is turned on, power from the power source Vcc2 is applied to a coil on the secondary side of the relay 451, and a contact on a primary side of the relay 451 is turned on. When the RLON 451 signal turns low, the transistor 461 is turned off, current from the power source Vcc2 flowing to the coil on the secondary side of the relay 451 is cut off, and the contact on the primary side of the relay 451 is turned off. Note that a resistor 471 is a current limit resistor. In the present exemplary embodiment, by controlling the relay 451, selection of whether to supply electric power to the heat generating block BLa-2 (or BLb-2) or to the heat generating blocks BLa-1 to BLa-3 (or BLb-1 to BLb-3) can be made. As described above, the relay 459 is a relay for selecting the first heat generating line or the second heat generating line, and the relay 451 is a relay for selecting the heat generating area in the longitudinal direction of the heater 300.

An operation of a driving circuit of the triac 416 will be described. Resistors 413 and 417 are bias resistors for the triac 416, and a phototriac coupler 415 is a device for obtaining a creepage distance between the primary and the secondary. Furthermore, by applying power to a light emitting diode of the phototriac coupler 415, the triac 416 is turned on. A resistor 418 is a resistor for limiting the electric current flowing from a power source Vcc to the light emitting diode of the phototriac coupler 415, and the phototriac coupler 415 is turned on and off with a transistor 419. The transistor 419 operates according to a FUSER 1 signal from the CPU 420 sent through a current limit resistor 412.

A method of controlling the temperature of the heater 300 will be described. In the present exemplary embodiment, control of the temperature of the heater 300 is performed based on the heater temperature detected by the thermistor TH1. A voltage signal according to the temperature of the thermistor TH1 is input to the CPU 420. With the above, the CPU 420 detects the temperature according to the signal TH1. In the internal processing of the CPU (a control unit) 420, the electric power that is to be supplied is calculated, for example, through PI control, on the basis of the detection temperature of the thermistor TH1 and a set temperature of the heater 300. Furthermore, conversion to a control level of a phase angle (phase control), a wavenumber (wavenumber control) that correspond to the supplied electric power is performed and the triac 416 is controlled with the above control condition.

5. Method of Controlling Heater According to Sheet Size

The control circuit 400 of the present exemplary embodiment is capable of selecting the heat generating area (the heat generating width) in four stages by controlling the relay 451 and the switching relay 459 according to width information of the recording material (or width information of the image forming area) input to the CPU 420. Referring to table 1, the relationship between the control states of the relay 451 and the switching relay 459, and the heat generating area of the heater in the longitudinal direction will be described.

TABLE 1

| To Where | ON/OFF | Electrification of Heat Generating Block | | | | Size of Paper |
|---|---|---|---|---|---|---|
| Switching Relay 459 is Connected | State of Relay 451 | BLa-2 | BLa-1 BLa-3 | BLb-2 | BLb-1 BLb-3 | Corresponding to Heat Generating Area |
| Group b of Heat Generating Blocks | OFF | NO | NO | YES | NO | DL Envelope and COM 10 Envelope |
| Group a of Heat Generating Blocks | OFF | YES | NO | NO | NO | A5 Paper |
| Group b of Heat Generating Blocks | ON | NO | NO | YES | YES | Executive Paper and B5 Paper |
| Group a of Heat Generating Blocks | ON | YES | YES | NO | NO | Letter Paper, Legal Paper, and A4 Paper |

When the switching relay 459 is connected to the group b of heat generating blocks (RLON 459 signal is low) and the relay 451 is off (RLON 451 signal is low), power can be applied to the heat generating block BLb-2. With the above, heat is generated in the width of 115 mm illustrated in FIG. 3B such that the heat generating area is for the DL envelope and the COM 10 envelope. When the switching relay 459 is connected to the group a of heat generating blocks (RLON 459 signal is high) and the relay 451 is off, power can be applied to the heat generating block BLa-2. With the above, heat is generated in the width of 157 mm illustrated in FIG. 3B such that the heat generating area is for A5 paper. When the switching relay 459 is connected to the group b of heat generating blocks and the relay 451 is on (RLON 451 signal is high), power can be applied to the heat generating blocks BLb-1 to BLb-3. With the above, heat is generated in the width of 190 mm illustrated in FIG. 3B such that the heat generating area is for executive paper and B5 paper. When the switching relay 459 is connected to the group a of heat generating blocks and the relay 451 is on, power can be applied to the heat generating blocks BLa-1 to BLa-3. With the above, heat is generated in the width of 220 mm illustrated in FIG. 3B such that the heat generating area is for letter paper, legal paper, and A4 paper.

As described above, the control circuit 400 of the present exemplary embodiment is capable of selecting the heat generating area (the heat generating width) in four stages according to the width information of the recording material P (or width information of the image forming area). Accordingly, generation of heat in the area of the heater 300 where the recording material P does not pass can be suppressed effectively. Furthermore, in the heater 300 of the present example, the electrodes E1 to E3 are common between the heating elements in the first heat generating line and the heating elements in the second heat generating line. Accordingly, the number of electrodes can be reduced advantageously.

Note that instead of a configuration that switches the destination of connection of the triac 416 with the switching relay 459, even when two triacs are connected to each of the group a of heat generating blocks and the group b of heat generating blocks, a similar advantageous effect as that of the first exemplary embodiment can be obtained.

Second Exemplary Embodiment

A second exemplary embodiment of the present invention will be described. The basic configuration and operation of the image forming apparatus of the second exemplary embodiment are the same as those of the first exemplary embodiment. Accordingly, elements and configurations that have the same or corresponding functions as those of the first exemplary embodiment will be attached with the same reference numerals and detailed description thereof will be omitted. Matters that are not particularly described in the second exemplary embodiment is similar to those of the first exemplary embodiment.

Figure 7A:
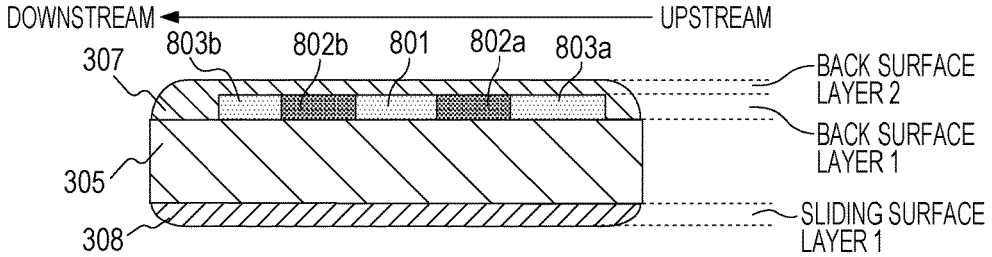
FIGS. 7A to 7C are block diagrams of a heater of a second exemplary embodiment.
Figure 7B:
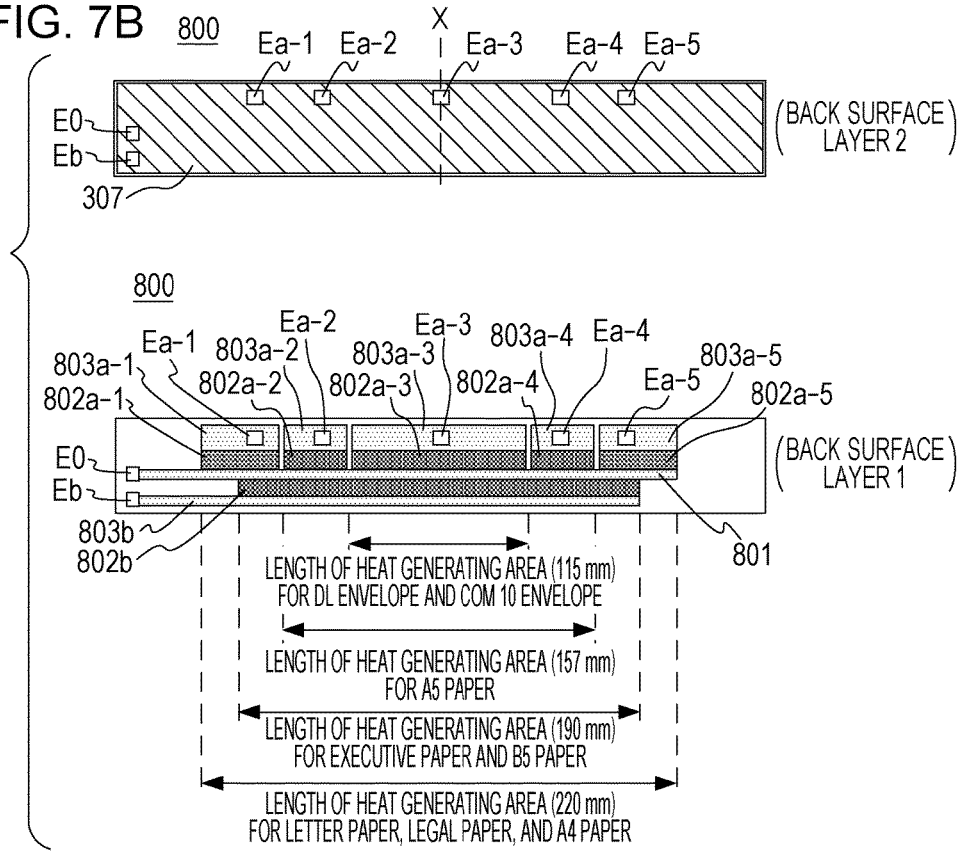
Figure 7C:
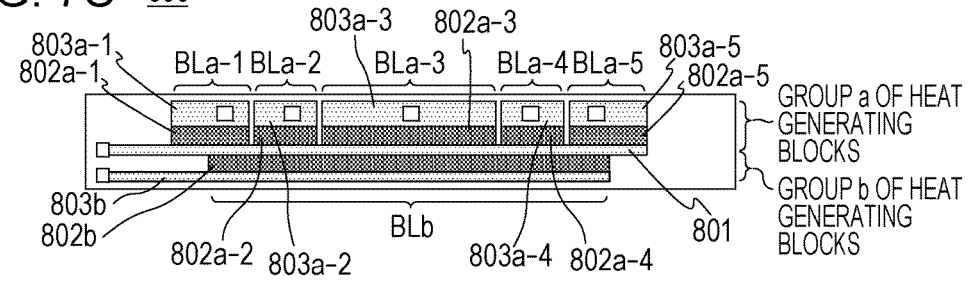

Referring to FIGS. 7A to 7C, a configuration of a heater (a heater 800) used in the second exemplary embodiment will be described in detail. FIG. 7A is a cross-sectional view of the heater 800. FIG. 7B illustrates plan views of layers of the heater 800. FIG. 7C is a diagram illustrating a positional relationship of the heat generating areas. While in the first exemplary embodiment, the first heat generating line and the second heat generating line both have a plurality of heat generating blocks, in the present exemplary embodiment, the second heat generating line has only one heat generating block.

The back surface layer 1 of the heater 800 includes a conductor 803*a* (803*a*-1 to 803*a*-5) and a conductor 803*b* that serve as the conductor B provided in the longitudinal direction of the heater 800. The conductor 803*b* is disposed downstream in the conveyance direction of the recording material P with respect to the conductor 803*a*. Furthermore, the back surface layer 1 includes a conductor 801 serving as a conductor A that is provided parallel to the conductors 803*a* and 803*b*. The conductor 801 is provided between the conductor 803*a* and the conductor 803*b* and in the longitudinal direction of the heater 800.

Furthermore, the back surface layer 1 includes a heating element 802*a* (802*a*-1 to 802*a*-5) and a heating element 802*b*. The heating elements 802*a* and 802*b* have a positive resistance temperature characteristic. The heating element 802*a* is provided between the conductor 801 and the conductor 803*a*, and generates heat by having electric power supplied thereto through the conductor 801 and the conductor 803*a*. The heating element 802*b* is provided between the conductor 801 and the conductor 803*b*, and generates heat by having electric power supplied thereto through the conductor 801 and the conductor 803*b*.

Similar to the first exemplary embodiment, a heating member constituted by the conductor 801, the conductor 803*a*, and the heating element 802*a* is divided in the longitudinal direction of the heater 800. In the second exemplary embodiment, the heating member is divided into five heat generating blocks (BLa-1 to BLa-5). In other words, the heat generating block BLa-3 including the heating element 802*a*-3 and a pair of conductors 803*a*-3 and 801 is provided in an area including the conveyance reference X. Furthermore, the heat generating blocks BLa-1, BLa-2, BLa-4, and BLa-5 including pairs including the heating elements 802*a*-1, 802*a*-2, 802*a*-4, and 802*a*-5 and the conductors 803*a*-1, 803*a*-2, 803*a*-4, and 803*a*-5, respectively, and the conductor 801 are provided. The five heat generating blocks BLa-1 to BLa-5 constitute the group a of heat generating blocks serving as the first heat generating line. Furthermore, although the second heat generating line is a single heat generating block BLb constituted by the conductor 801, the conductor 803*b*, and the heating element 802*b*, the second heat generating line will be referred to as the group b of heat generating blocks.

Boundary positions between the heat generating blocks that constitute the group a of heat generating blocks are set in a bilaterally symmetrical manner with the conveyance reference X of the recording material P as the central axis. In other words, the boundary between the heat generating block BLa-1 and the heat generating block BLa-2, and the boundary between the heat generating block BLa-4 and the heat generating block BLa-5 are set at positions that are 78.5 mm in the left and right from the conveyance reference X. Furthermore, the boundary between the heat generating blocks BLa-2 and BLa-3, and the boundary between the heat generating blocks BLa-3 and BLa-4 are set at positions that are 57.5 mm in the left and right from the conveyance reference X. The entire length of the group a of heat generating blocks is 220 mm. Furthermore, the entire length of the heat generating block BLb is 190 mm.

The heater 800 is provided with electrodes E0, Ea-1, Ea-2, Ea-3, Ea-4, Ea-5, and Eb. The electrode E0 is an electrode for supplying electric power to the group a of heat generating blocks and the heat generating block BLb through the conductor 801. The electrodes Ea-1 to Ea-5 are electrodes for supplying electric power to the heat generating blocks BLa-1 to BLa-5, respectively, through the conductors 803*a*-1 to 803*a*-5, respectively. The electrode Eb is an electrode for supplying electric power to the heat generating block BLb through the conductor 803*b*.

The surface protecting layer 307 constituting the back surface layer 2 is formed at a portion other than the portions of the electrodes E0, Ea-1 to Ea-5, and Eb. Accordingly, electric contacts C for supplying electric power can be connected to each electrode from the back surface side of the heater 800. Feeding cables are connected to the electric contacts C for supplying electric power from a control circuit 900 described later.

Figure 8:
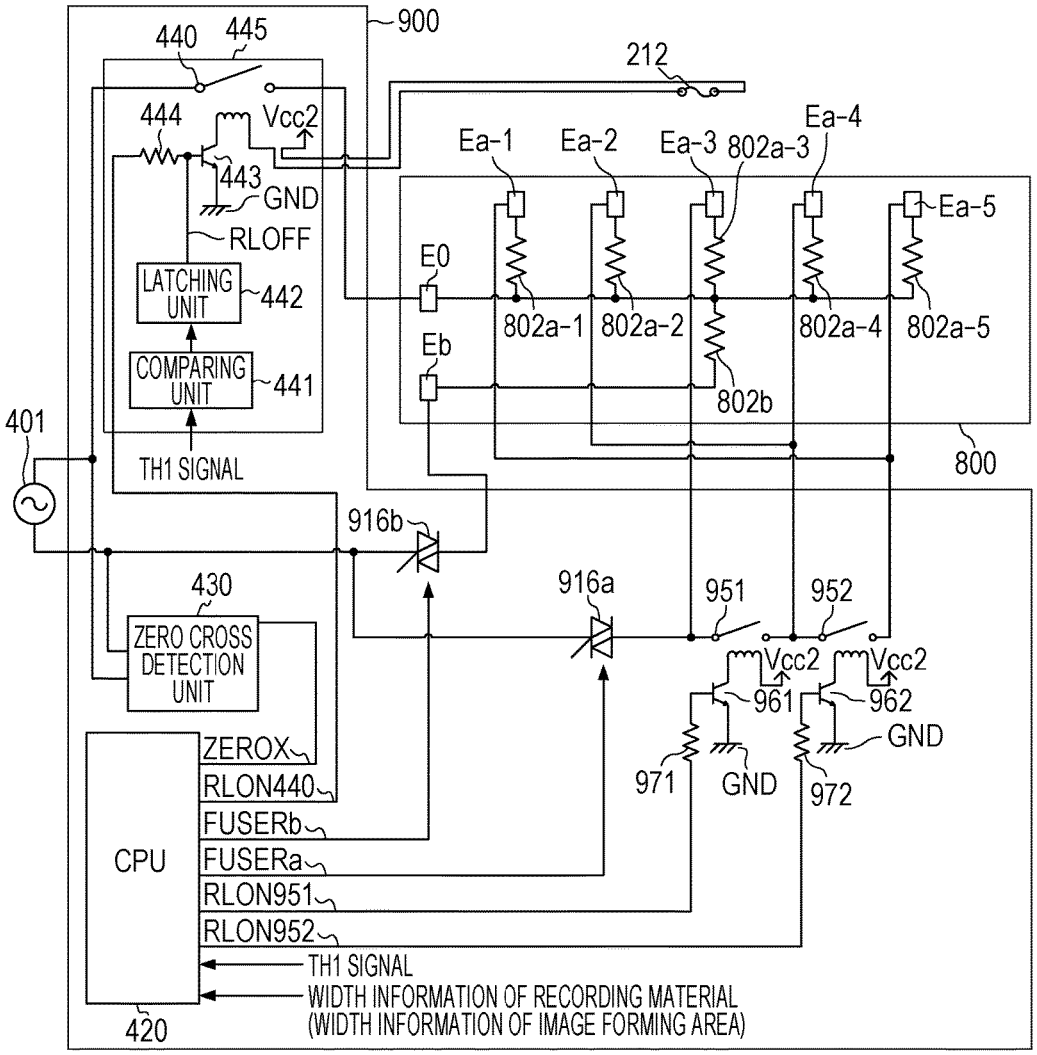
FIG. 8 is a control circuit diagram of the heater of the second exemplary embodiment.

Referring to FIG. 8, the control circuit 900 of the second exemplary embodiment will be described. The control circuit 900 is capable of switching the heat generating area of the heater in the longitudinal direction by using a relay 951, a relay 952, a triac 916*a*, and a triac 916*b*. Since the method of selecting the heat generating block using the relays 951 and 952 is similar to that of the relay 451 of the first exemplary embodiment (transistors 961 and 962 correspond to the transistor 461, and resistors 971 and 972 correspond to the resistor 471), description thereof will be omitted. Furthermore, since the circuit operation of the triacs 916*a* and 916*b* is also similar to that of the triac 416 of the first exemplary embodiment, description thereof will be omitted. Note that FIG. 8 is illustrated while omitting the driving circuits of the triacs.

Referring to table 2, the relationship between the control states of the relays 951 and 952 and the triacs 916*a* and 916*b*, and the heat generating area of the heater 800 in the longitudinal direction will be described.

TABLE 2

| State of Triac | | ON/OFF State of Relay | | Electrification of Heat Generating Block BLa-2 BLa-1 | | | | Size of Paper Corresponding to |
|---|---|---|---|---|---|---|---|---|
| 916a | 916b | 951 | 952 | BLa-3 | BLa-4 | Bla-5 | BLb | Heat Generating Area |
| Actuated | OFF | OFF | OFF | YES | NO | NO | NO | DL Envelope and COM 10 Envelope |
| Actuated | OFF | ON | OFF | YES | YES | NO | NO | A5 Paper |
| OFF | Actuated | Optional | Optional | NO | NO | NO | YES | Executive Paper and B5 Paper |
| Actuated | OFF | ON | ON | YES | YES | YES | NO | Letter Paper, Legal Paper, and A4 Paper |

When the triac 916*b* is off and the relays 951 and 952 are both off, power can be applied to only the heat generating block BLa-3. With the above, heat is generated in the width of 115 mm illustrated in FIG. 7B such that the heat generating area is for the DL envelope and the COM 10 envelope. When the triac 916*b* is off, the relay 951 is on, and the relay 952 is off, power can be applied to the heat generating blocks BLa-2 to BLa-4. With the above, heat is generated in the width of 157 mm illustrated in FIG. 7B such that the heat generating area is for A5 paper. When the triac 916*a* is off, power can be applied to the heat generating block BLb. With the above, heat is generated in the width of 190 mm illustrated in FIG. 7B such that the heat generating area is for executive paper and B5 paper. When the triac 916*b* is off and the relays 951 and 952 are both on, power can be applied to the heat generating blocks BLa-1 to BLa-5. With the above, heat is generated in the width of 220 mm illustrated in FIG. 7B such that the heat generating area is for letter paper, legal paper, and A4 paper.

As described above, the control circuit 900 of the present exemplary embodiment is capable of selecting the heat generating area (the heat generating width) according to the width information of the recording material P (or width information of the image forming area). Accordingly, generation of heat in the area of the heater 800 where the recording material P does not pass can be suppressed effectively.

Third Exemplary Embodiment

A third exemplary embodiment of the present invention will be described. The basic configuration and operation of the image forming apparatus of the third exemplary embodiment are the same as those of the first exemplary embodiment. Accordingly, elements and configurations that have the same or corresponding functions as those of the first exemplary embodiment will be attached with the same reference numerals and detailed description thereof will be omitted. Matters that are not particularly described in the third exemplary embodiment is similar to those of the first exemplary embodiment.

Figure 9A:
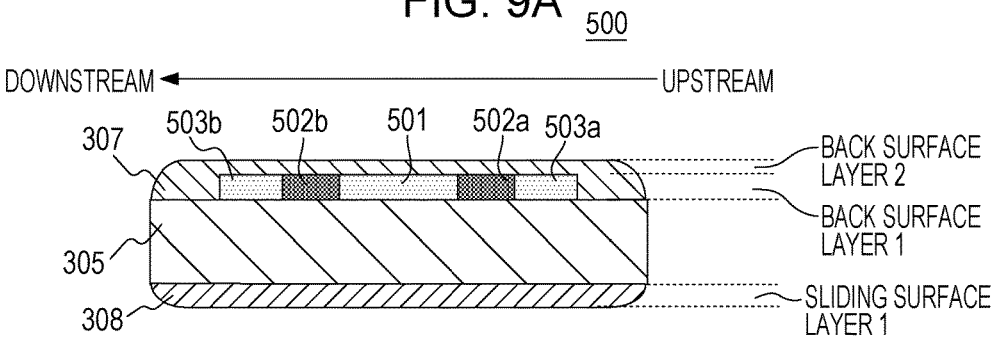
FIGS. 9A and 9B are block diagrams of a heater of a third exemplary embodiment.
Figure 9B:
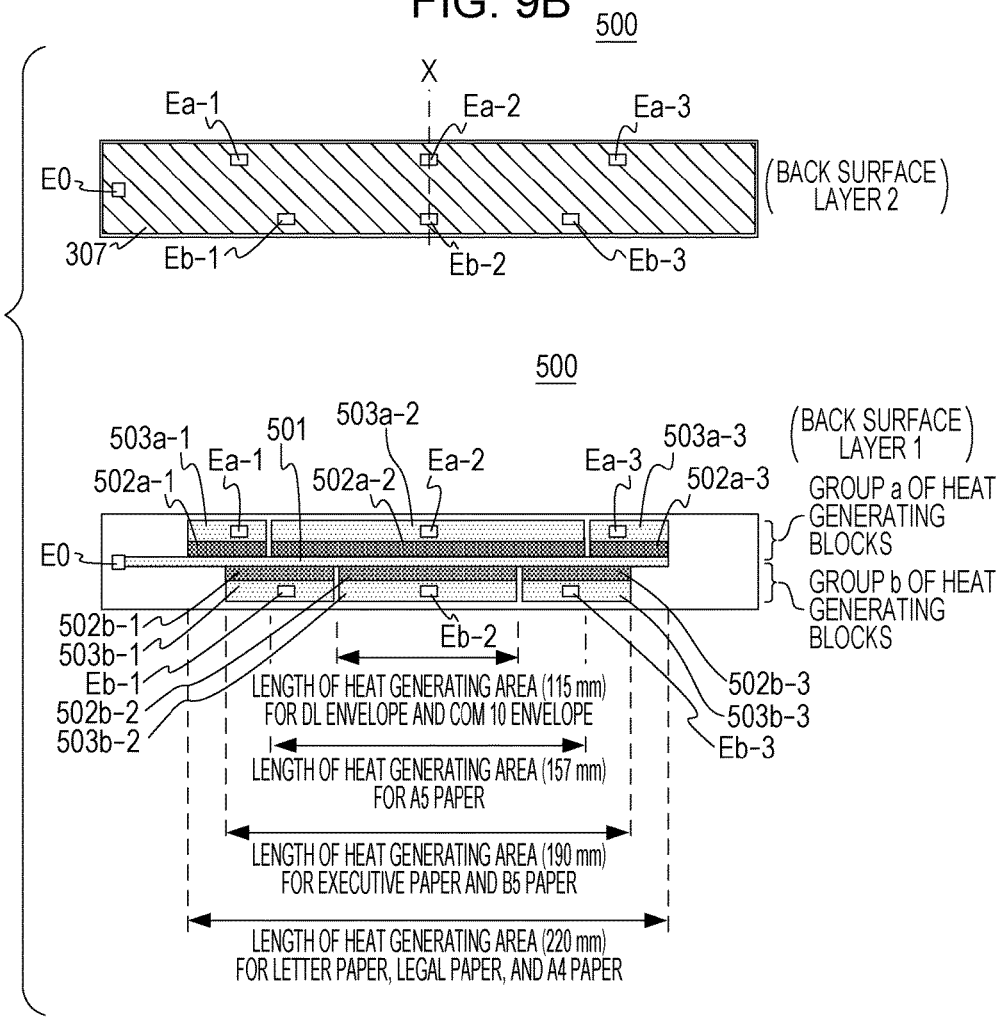

Referring to FIGS. 9A and 9B, a configuration of a heater (a heater 500) used in the third exemplary embodiment will be described in detail. FIG. 9A is cross-sectional view of the heater 500. FIG. 9B illustrates plan views of layers of the heater 500. In the first exemplary embodiment, the conductor B (the conductor 303) serves as a common conductive path of the group a of heat generating blocks and the group b of heat generating blocks; however, in the third exemplary embodiment, the conductor A (a conductor 501) is the common conductive path of the group a of heat generating blocks and the group b of heat generating blocks.

The back surface layer 1 of the heater 500 includes a conductor 503*a* (503*a*-1, 503*a*-2, and 503*a*-3) and a conductor 503*b* (503*b*-1, 503*b*-2, and 503*b*-3) that serve as the conductor B provided in the longitudinal direction of the heater 500. The conductor 503*b* is disposed downstream in the conveyance direction of the recording material P with respect to the conductor 503*a*. Furthermore, the back surface layer 1 includes a conductor 501 serving as a conductor A that is provided parallel to the conductors 503*a* and 503*b*. The conductor 501 is provided between the conductor 503*a* and the conductor 503*b* and in the longitudinal direction of the heater 500.

Furthermore, the back surface layer 1 includes a heating element 502*a* (502*a*-1, 502*a*-2, and 502*a*-3) and a heating element 502*b* (502*b*-1, 502*b*-2, and 502*b*-3). The heating elements 502*a* and 502*b* have a positive resistance temperature characteristic. The heating element 502*a* is provided between the conductor 501 and the conductor 503*a*, and generates heat by having electric power supplied thereto through the conductor 501 and the conductor 503*a*. The heating element 502*b* is provided between the conductor 501 and the conductor 503*b*, and generates heat by having electric power supplied thereto through the conductor 501 and the conductor 503*b*.

Similar to the first exemplary embodiment, the heating member constituted by the conductor 501, the conductor 503*a*, and the heating element 502*a* is divided into three heat generating blocks (BLa-1, BLa-2, and BLa-3) in the longitudinal direction of the heater 500. The three heat generating blocks BLa-1, BLa-2, and BLa-3 constitute the group a of the heat generating blocks serving as the first heat generating line. Similar to the first exemplary embodiment, the heating member constituted by the conductor 501, the conductor 503*b*, and the heating element 502*b* is divided into three heat generating blocks (BLb-1, BLb-2, and BLb-3) in the longitudinal direction of the heater 500. The three heat generating blocks BLb-1, BLb-2, and BLb-3 constitute the group b of heat generating blocks serving as the second heat generating line.

The divided positions of the group a of heat generating blocks and the group b of heat generating blocks in the longitudinal direction, and the entire length of each of the groups of heat generating blocks are set the same as those of the first exemplary embodiment. Furthermore, the group a of heat generating blocks and the group b of heat generating blocks set the conductor 501 serving as the conductor A as a common conductive path.

The heater 500 is provided with electrodes E0, Ea-1, Ea-2, Ea-3, Eb-1, Eb-2, and Eb-3. The electrode E0 is an electrode for supplying electric power to the group a of heat generating blocks and the group b of heat generating blocks through the conductor 501. The electrode Ea-1 is an electrode for supplying electric power to the heat generating block BLa-1 through the conductor 503*a*-1. The electrode Ea-2 is an electrode for supplying electric power to the heat generating block BLa-2 through the conductor 503*a*-2. The electrode Ea-3 is an electrode for supplying electric power to the heat generating block BLa-3 through the conductor 503*a*-3. The electrode Eb-1 is an electrode for supplying electric power to the heat generating block BLb-1 through the conductor 503*b*-1. The electrode Eb-2 is an electrode for supplying electric power to the heat generating block BLb-2 through the conductor 503*b*-2. The electrode Eb-3 is an electrode for supplying electric power to the heat generating block BLb-3 through the conductor 503*b*-3.

The surface protecting layer 307 constituting the back surface layer 2 is formed at a portion other than the portions of the electrodes E0, Ea-1, Ea-2, Ea-3, Eb-1, Eb-2, and Eb-3. Accordingly, electric contacts C for supplying electric power can be connected to each electrode from the back surface side of the heater 500. Feeding cables are connected to the electric contacts C for supplying electric power from a control circuit 600 described later.

Figure 10:
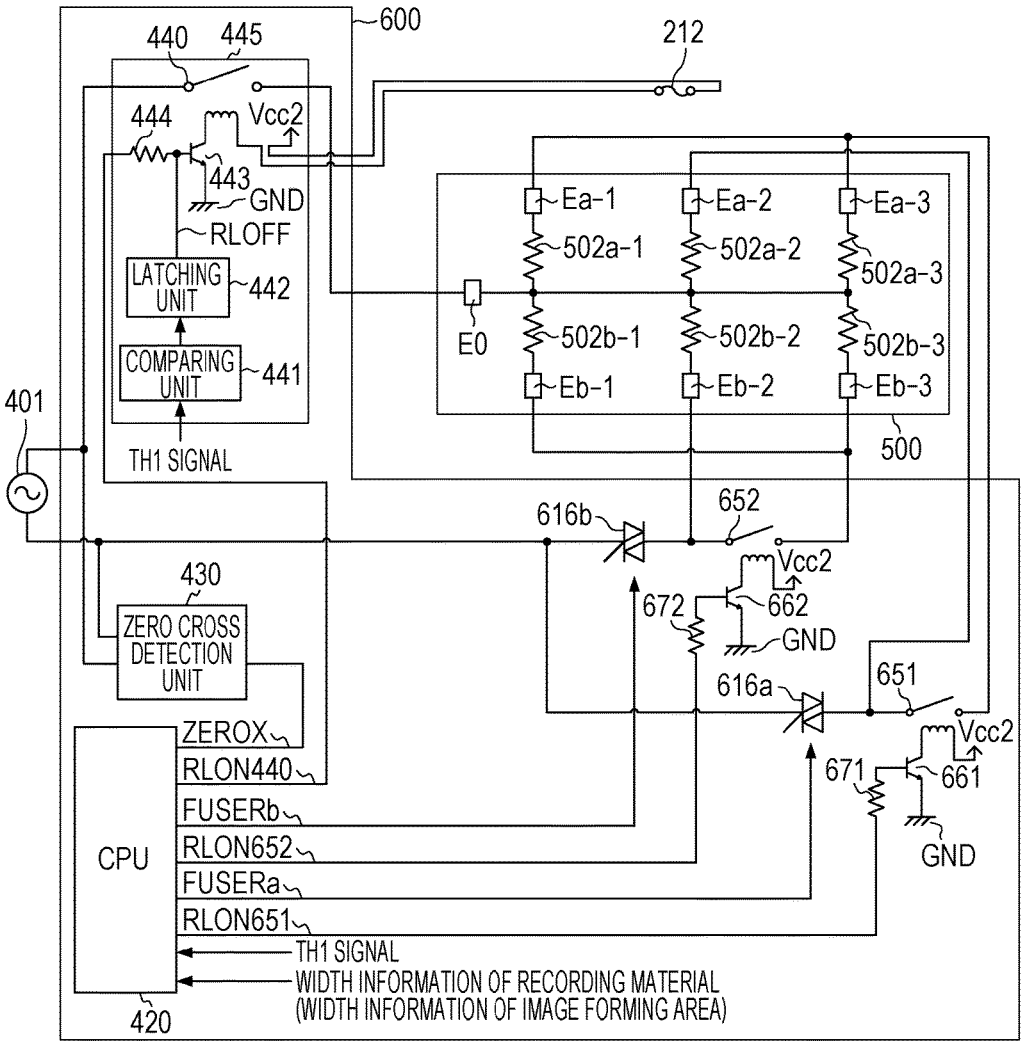
FIG. 10 is a control circuit diagram of the heater of the third exemplary embodiment.

Referring to FIG. 10, the control circuit 600 of the third exemplary embodiment will be described. The control circuit 600 is capable of switching the heat generating area of the heater in the longitudinal direction by using a relay 651, a relay 652, a triac 616*a*, and a triac 616*b*. Since the method of selecting the heat generating block using the relays 651 and 652 is similar to that of the relay 451 of the first exemplary embodiment (transistors 661 and 662 correspond to the transistor 461, and resistors 671 and 672 correspond to the resistor 471), description thereof will be omitted. Furthermore, since the circuit operation of the triacs 616*a* and 616*b* is also similar to that of the triac 416 of the first exemplary embodiment, description thereof will be omitted. Note that FIG. 10 is illustrated while omitting the driving circuits of the triacs.

Referring to table 3, the relationship between the control states of the relays 651 and 652 and the triacs 616*a* and 616*b*, and the heat generating area of the heater in the longitudinal direction will be described.

TABLE 3

| State of Triac | | ON/OFF State of Relay | | Electrification of Heat Generating Block | | | | Size of Paper Corresponding to Heat Generating Area |
|---|---|---|---|---|---|---|---|---|
| | | | | BLa-1 | | | BLb-1 | |
| 616a | 616b | 651 | 652 | BLa-2 | BLa-3 | BLb-2 | BLB-3 | |
| OFF | Actuated | Optional | OFF | NO | NO | YES | NO | DL Envelope and COM 10 Envelope |
| Actuated | OFF | OFF | Optional | YES | NO | NO | NO | A5 Paper |
| OFF | Actuated | Optional | ON | NO | NO | YES | YES | Executive Paper and B5 Paper |
| Actuated | OFF | ON | Optional | YES | YES | NO | NO | Letter Paper, Legal Paper, and A4 Paper |

When the triac 616*a* is off and the relay 652 is off, power can be applied to only the heat generating block BLb-2. With the above, heat is generated in the width of 115 mm illustrated in FIG. 9B such that the heat generating area is for the DL envelope and the COM 10 envelope. When the triac 616*b* is off and the relay 651 is off, power can be applied to only the heat generating block BLa-2. With the above, heat is generated in the width of 157 mm illustrated in FIG. 9B such that the heat generating area is for A5 paper. When the triac 616*a* is off and the relay 652 is on, power can be applied to the heat generating blocks BLb-1 to BLb-3. With the above, heat is generated in the width of 190 mm illustrated in FIG. 9B such that the heat generating area is for executive paper and B5 paper. When the triac 616*b* is off and the relay 651 is on, power can be applied to the heat generating blocks BLa-1 to BLa-3. With the above, heat is generated in the width of 220 mm illustrated in FIG. 9B such that the heat generating area is for letter paper, legal paper, and A4 paper.

As described above, the control circuit 600 of the present exemplary embodiment is capable of selecting the heat generating area (the heat generating width) according to the width information of the recording material P (or width information of the image forming area). Accordingly, generation of heat in the area of the heater 500 where the recording material P does not pass can be suppressed effectively.

Fourth Exemplary Embodiment

A fourth exemplary embodiment of the present invention will be described. The basic configuration and operation of the image forming apparatus of the fourth exemplary embodiment are the same as those of the third exemplary embodiment. Accordingly, elements and configurations that have the same or corresponding functions as those of the third exemplary embodiment will be attached with the same reference numerals and detailed description thereof will be omitted. Matters that are not particularly described in the fourth exemplary embodiment is similar to those of the third exemplary embodiment.

Figure 11A:
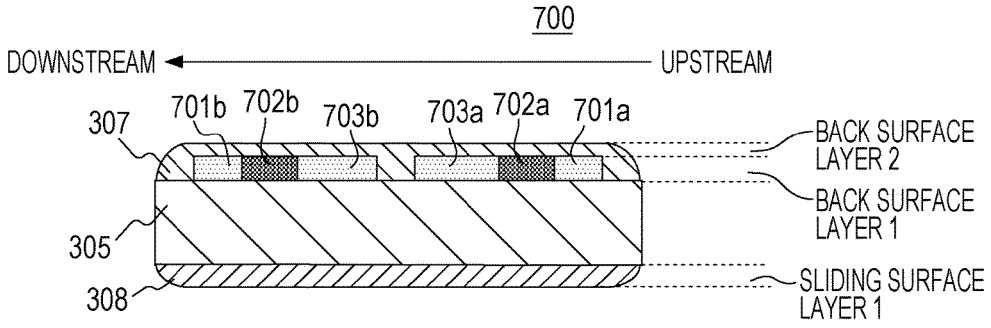
FIGS. 11A and 11B are block diagrams of a heater of a fourth exemplary embodiment.
Figure 11B:
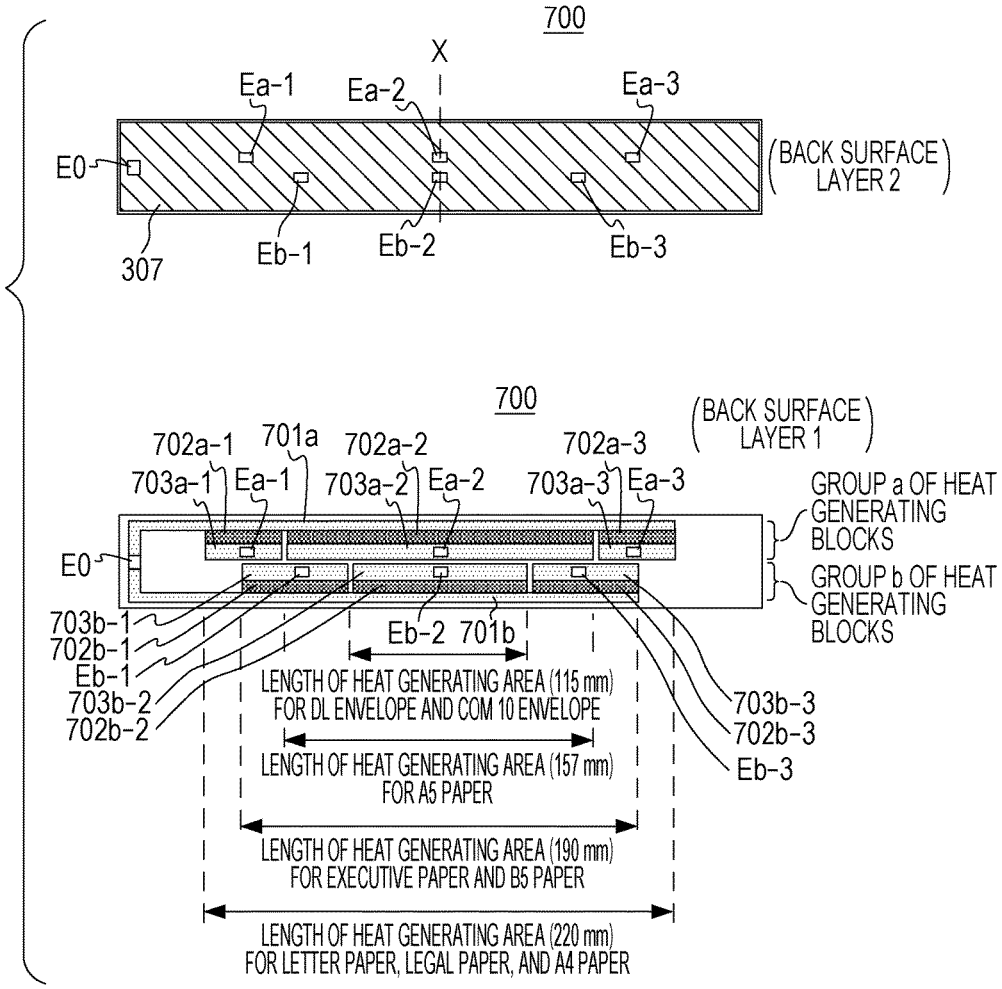

Referring to FIGS. 11A and 11B, a configuration of a heater (a heater 700) used in the fourth exemplary embodiment will be described in detail. FIG. 11A is a cross-sectional view of the heater 700. FIG. 11B illustrates plan views of layers of the heater 700.

The heater 700 of the fourth exemplary embodiment includes a conductor 701 serving as the conductor A. The conductor 701 is provided in the longitudinal direction of the heater 700, and is divided into a conductor 701*a* that is disposed on the upstream side in the conveyance direction of the recording material P, and a conductor 701*b* that is disposed on the downstream side in the conveyance direction of the recording material P. A conductor 703 serving as the conductor B is provided between the conductor 701*a* and the conductor 701*b*. The conductor 703 is provided in the longitudinal direction of the heater 700 and is divided into a conductor 703*a* (703*a*-1 to 703*a*-3) and a conductor 703*b* (703*b*-1 to 703*b*-3) in a short direction of the heater 700.

A heating element 702*a* (702*a*-1 to 702*a*-3) is provided between the conductors 701*a* and 703*a* and generates heat by having electric power supplied thereto through the conductor 701*a* and the conductor 703*a*. A heating element 702*b* (702*b*-1 to 702*b*-3) is provided between the conductors 701*b* and 703*b* and generates heat by having electric power supplied thereto through the conductor 701*b* and the conductor 703*b*.

Similar to the third exemplary embodiment, the heating member constituted by the conductor 701*a*, the conductor 703*a*, and the heating element 702*a* is divided into three heat generating blocks (BLa-1, BLa-2, and BLa-3) in the longitudinal direction of the heater 700. The three heat generating blocks BLa-1, BLa-2, and BLa-3 constitute the group a of the heat generating blocks serving as the first heat generating line. Similar to the third exemplary embodiment, the heating member constituted by the conductor 701*b*, the conductor 703*b*, and the heating element 702*b* is divided into three heat generating blocks (BLb-1, BLb-2, and BLb-3) in the longitudinal direction of the heater 700. The three heat generating blocks BLb-1, BLb-2, and BLb-3 constitute the group b of heat generating blocks serving as the second heat generating line.

The divided positions of the group a of heat generating blocks and the group b of heat generating blocks in the longitudinal direction, and the entire length of each of the groups of heat generating blocks are set the same as those of the third exemplary embodiment.

The heater 700 is provided with electrodes E0, Ea-1, Ea-2, Ea-3, Eb-1, Eb-2, and Eb-3. The electrode E0 is an electrode for supplying electric power to the group a of heat generating blocks and the group b of heat generating blocks through the conductor 701. The electrode Ea-1 is an electrode for supplying electric power to the heat generating block BLa-1 through the conductor 703*a*-1. The electrode Ea-2 is an electrode for supplying electric power to the heat generating block BLa-2 through the conductor 703*a*-2. The electrode Ea-3 is an electrode for supplying electric power to the heat generating block BLa-3 through the conductor 703*a*-3. The electrode Eb-1 is an electrode for supplying electric power to the heat generating block BLb-1 through the conductor 703*b*-1. The electrode Eb-2 is an electrode for supplying electric power to the heat generating block BLb-2 through the conductor 703*b*-2. The electrode Eb-3 is an electrode for supplying electric power to the heat generating block BLb-3 through the conductor 703*b*-3. Similar to the third exemplary embodiment, the feeding cables are connected to the electrodes through the electric contacts C.

The heater 700 of the fourth exemplary embodiment is capable of controlling heat generation by using the control circuit 600 of the third exemplary embodiment. Similar to the third exemplary embodiment, the heat generating area (the heat generating width) can be selected according to the width information of the recording material P (or the width direction of the image forming area), and temperature rise in the sheet non-passing portion can be suppressed in a variety of sheet sizes.

The present disclosure is not limited to the number of divisions of the heat generating block illustrated in the first to fourth exemplary embodiments. Furthermore, there may be three or more heat generating lines (groups of heat generating blocks).

Figure 12:
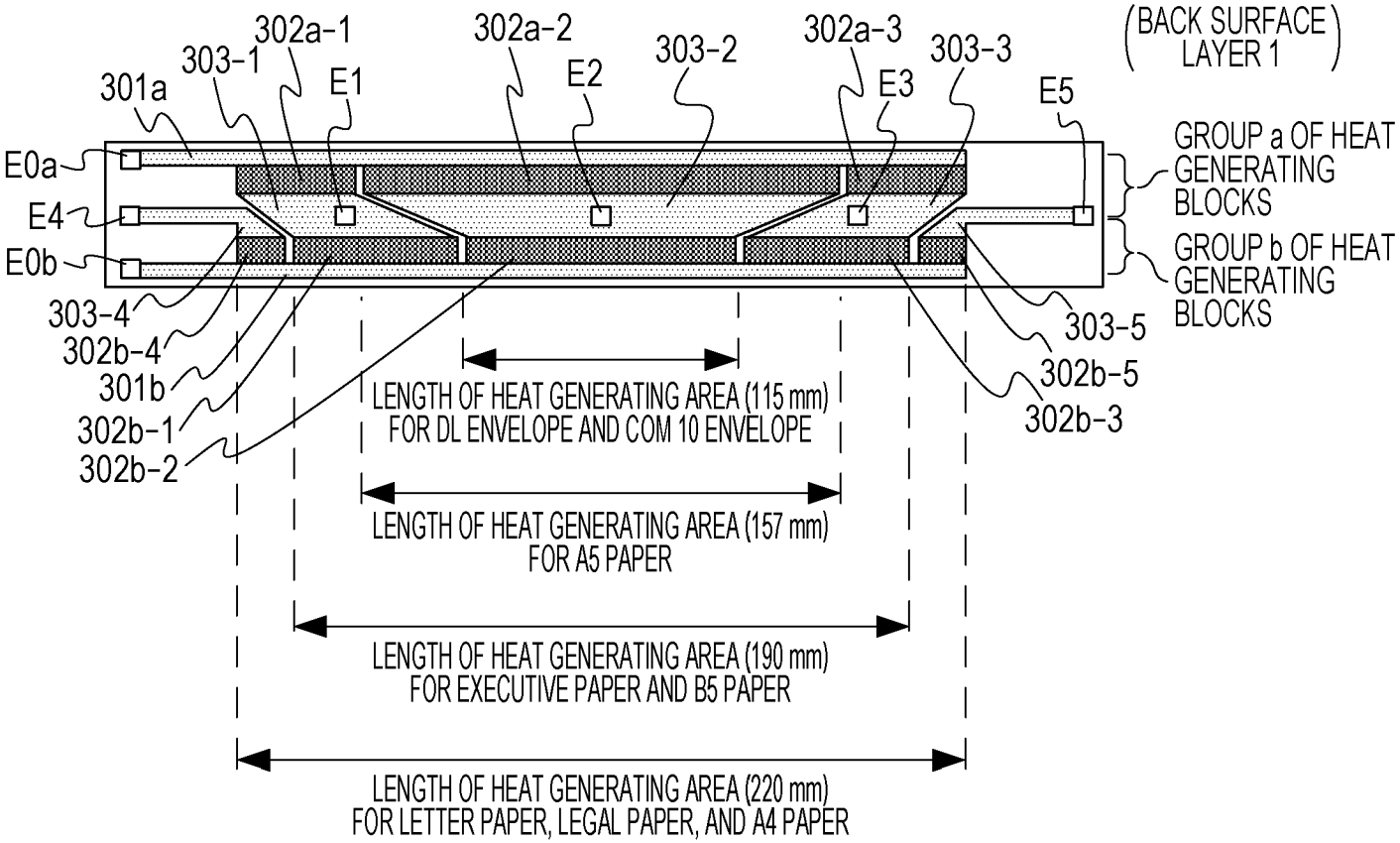
FIG. 12 is a diagram illustrating a modification of the heater of the first exemplary embodiment.

Furthermore, in the first to fourth exemplary embodiment, the entire length of the group a of heat generating blocks and that of the group b of heat generating blocks are not the same; however, the entire lengths may be made the same. For example, as illustrated in FIG. 12, heating elements 302*b*-4 and 302*b*-5, conductors 303-4 and 303-5, and electrodes E4 and E5 are added to the heater 300 of the first exemplary embodiment. In doing so, the entire length of the group b of heat generating blocks may be the same as the entire length of the group a of heat generating blocks, that is, the entire length may be 220 mm.

Furthermore, in the first to fourth exemplary embodiments, regarding the application of power to the group a of heat generating blocks and the group b of heat generating blocks, description has been given of a method of applying power to either one of the group a of heat generating blocks and the group b of heat generating blocks. However, a control method may be adopted in which the group a of heat generating blocks and the group b of heat generating blocks are configured to generate heat at the same time by setting a power application ratio between the group a of heat generating blocks and the group b of heat generating blocks. In such a case, a configuration such as the control circuit 600 in which a triac is connected to each of the group a of heat generating blocks and the group b of heat generating blocks is needed.

While aspects of the present invention have been described with reference to exemplary embodiments, it is to be understood that the aspects of the invention are not limited to the disclosed exemplary embodiments. The scope of the following claims is to be accorded the broadest interpretation so as to encompass all such modifications and equivalent structures and functions.

This application claims the benefit of Japanese Patent Application No. 2015-181135, filed Sep. 14, 2015, which is hereby incorporated by reference herein in its entirety.

What is claimed is:

1. A heater comprising:

a substrate;

a first heat generating line provided on the substrate and in a longitudinal direction of the substrate, the first heat generating line being divided into a plurality of heat generating blocks in the longitudinal direction, the plurality of heat generating blocks being controllable independently; and a second heat generating line provided on the substrate and in the longitudinal direction of the substrate, the second heat generating line being divided into a plurality of heat generating blocks in the longitudinal direction, the plurality of heat generating blocks being controllable independently, wherein divided positions of the first heat generating line and divided positions of the second heat generating line are different in the longitudinal direction, and wherein the first heat generating line and the second heat generating line are each configured such that an electric current flows in a heating element of the heat generating blocks of the first heat generating line and a heating element of the heat generating blocks in the second heat generating line in a direction that intersects the longitudinal direction.

2. The heater according to claim 1, wherein the heat generating blocks of the first heat generating line and the heat generating blocks of the second heat generating line include a pair of conductors provided in the longitudinal direction, and the heating element that is connected between the conductors.

3. The heater according to claim 1, wherein a heat generating area of an entire first heat generating line in the longitudinal direction and a heat generating area of an entire second heat generating line in the longitudinal direction are different.

4. The heater according to claim 1, wherein a heat distribution of one of the heat generating blocks of the first heat generating line in the longitudinal direction is a heat distribution that cannot be formed by combining one, or two or more heat generating blocks in the second heat generating line.

5. An image heating apparatus that heats an image formed on a recording material, the image heating apparatus comprising:

a cylindrical film; and a heater that is in contact with an inner surface of the film, wherein the apparatus heats an image formed on a recording material with heat of the heater while having a film in between, and wherein the heater is a heater according to claim 1.

6. The image heating apparatus according to claim 5, further comprising:

a control unit that controls the heater, wherein the control unit sets a power application ratio between a plurality of heat generating blocks of at least one of the first heat generating line and the second heat generating line according to a size of the recording material.

7. The image heating apparatus according to claim 5, further comprising:

a control unit that sets a power application ratio between one or more heat generating blocks of the first heat generating line and one or more heat generating blocks of the second heat generating line according to a size of the recording material.

* * * * *